US007442131B2

(12) United States Patent
Milana

(10) Patent No.: US 7,442,131 B2
(45) Date of Patent: Oct. 28, 2008

(54) PUTTER TYPE GOLF CLUB AND A METHOD OF USING IT

(76) Inventor: Dario Milana, Via Plinio, 69, Milano (IT) 20129

( * ) Notice: Subject to any disclaimer, the term of this patent is extended or adjusted under 35 U.S.C. 154(b) by 0 days.

(21) Appl. No.: 10/599,910

(22) PCT Filed: Apr. 11, 2005

(86) PCT No.: PCT/IT2005/000199

§ 371 (c)(1),
(2), (4) Date: Dec. 30, 2006

(87) PCT Pub. No.: WO2005/099829

PCT Pub. Date: Oct. 27, 2005

(65) Prior Publication Data

US 2007/0191136 A1 Aug. 16, 2007

(30) Foreign Application Priority Data

Apr. 13, 2004 (IT) ..... MI2004A0730

(51) Int. Cl.
*A63B 53/06* (2006.01)
*A63B 53/16* (2006.01)

(52) U.S. Cl. ..... 473/293; 473/295; 473/296; 473/300; 473/314; 473/336

(58) Field of Classification Search ..... 473/300–303, 473/293, 295, 340–341, 314, 336, 296
See application file for complete search history.

(56) References Cited

U.S. PATENT DOCUMENTS 3,226,120 A * 12/1965 Borah ..... 473/412
3,394,937 A * 7/1968 Allport ..... 473/293
4,306,721 A * 12/1981 Doyle ..... 473/238
4,508,342 A * 4/1985 Drake ..... 473/204
4,981,297 A * 1/1991 Foster ..... 473/206
5,090,698 A 2/1992 Kleinfelter
5,433,441 A * 7/1995 Olsen et al. ..... 473/328
5,501,461 A * 3/1996 Donofrio ..... 473/251
5,531,446 A * 7/1996 Scheie et al. ..... 473/227
5,616,089 A 4/1997 Miller
5,816,931 A * 10/1998 Schooler ..... 473/248
5,830,081 A 11/1998 Kitahara
5,993,324 A * 11/1999 Gammil ..... 473/251
6,126,555 A * 10/2000 Schooler ..... 473/248
6,190,266 B1 2/2001 Pamias
2004/0147337 A1* 7/2004 Cosmo ..... 473/293

(Continued)

*Primary Examiner*—Stephen L. Blau
(74) *Attorney, Agent, or Firm*—Themis Intellectual Property Counsel

(57) ABSTRACT

In one embodiment, a golf club of the so called putter type includes a cylinder shaped head having a vertical semi-through hole placed in the middle of the cylindrical surface, a second threaded hole perpendicular to the first hole for the insertion of a screw, and a shaft of adjustable length inserted in the first hole. The shaft includes a first portion inserted in said semi-through hole, vertically and orthogonally relative to said head, and further includes portions that are one opposite to the other and bent at an angle in relation to the first vertical portion, of which an angled upper portion is disposed parallel to the ground when the club is in its position of use, said end in turn supporting a grip formed by two spheres of different diameters, with the inner sphere configured to slide along the shaft.

10 Claims, 8 Drawing Sheets

U.S. PATENT DOCUMENTS

2004/0242340 A1* 12/2004 Welsh et al. ..... 473/295
2004/0259654 A1* 12/2004 Failla et al. ..... 473/230
2005/0026715 A1* 2/2005 Sloboda ..... 473/330
2006/0247070 A1* 11/2006 Funk et al. ..... 473/222

* cited by examiner

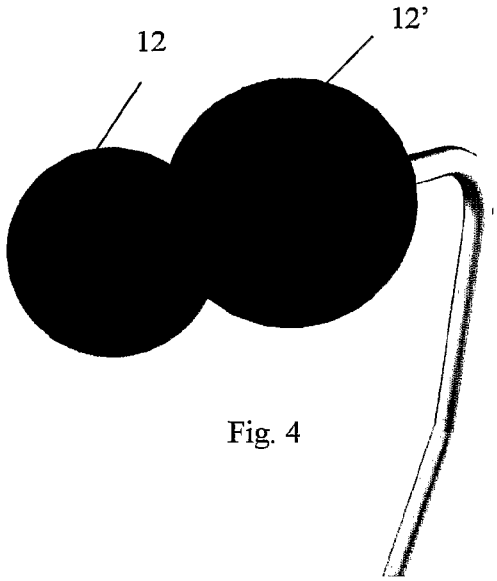
Fig. 4
Fig. 5
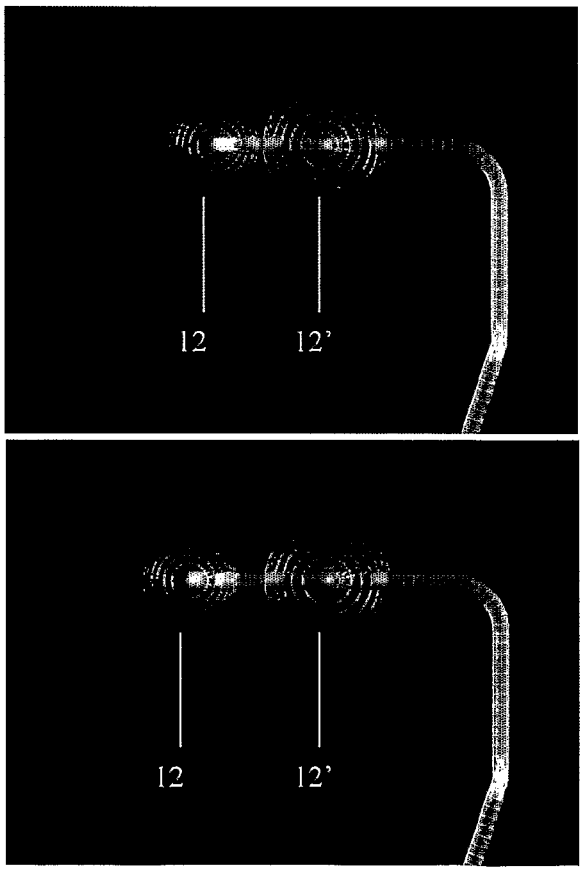
Fig. 6

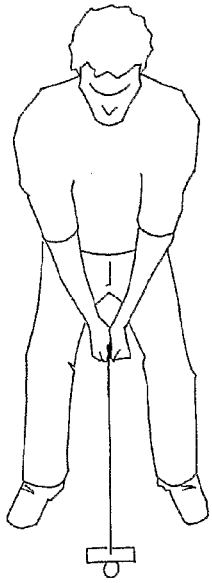
Fig. 14
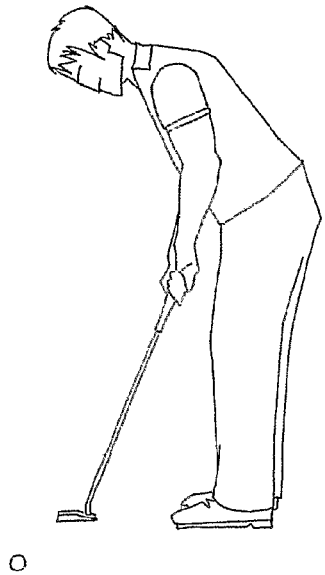
Fig. 15
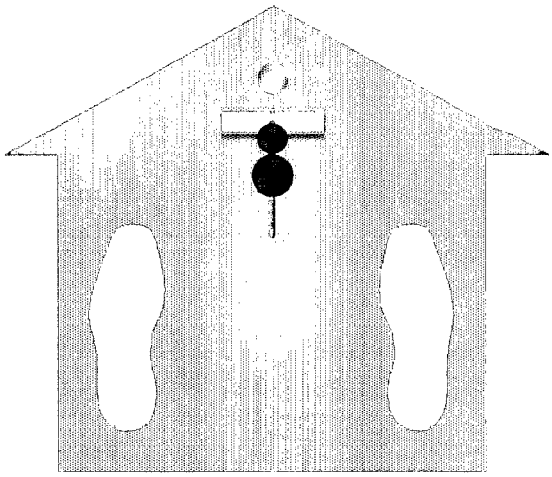
A
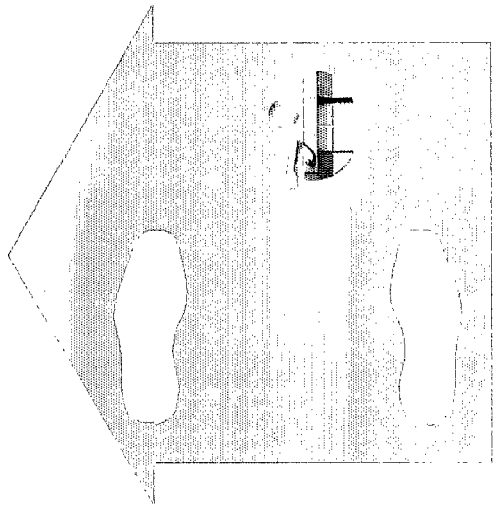
B

PUTTER TYPE GOLF CLUB AND A METHOD OF USING IT

FIELD OF THE INVENTION

The present invention relates to a golf club of the so called putter type that includes a cylinder shaped head with a centrally placed vertical hole, through which the shaft is inserted, said shaft, of adjustable length, being appropriately shaped and terminating with a grip formed by two spheres of different diameter, which have adjustable reciprocal positions and which provide for an ergonomic grip. More particularly, the present invention relates to a method of performing the decisive shot on the green, where the player hits the ball in a frontal position with respect to the target (hole), moving said club toward himself in the load phase and subsequently letting the ball be hit by the cylindrical head, with a pendulum like movement, in which said head oscillates between the legs of the player.

BACKGROUND OF THE INVENTION

The importance of the grip in performing a hitting shot is well known, especially during a putt when the ball must be holed. For instance, U.S. Pat. No. 5,616,089 describes and claims a method of performing the decisive shot, the so called putt, by means of which it seems possible to control the speed of the stroke and the direction of the shot. This method essentially envisages gripping the club with the dominant hand and placing the other hand on the wrist of the dominant hand in order to obtain a certain stabilization of said dominant hand without any appreciable influence on the shot. The shot is performed with the traditional address position, where the body of the golfer is parallel to the oscillation of the club. Such a position can, however, cause problems even in the stabilization of the stroking hand or in the trajectory of the ball, when one bears in mind that said ball must be hit with a specific position of the head of the golf club.

U.S. Pat. No. 5,090,698, among other things, describes a cylindrical shape clubhead, in which the impact area with the ball essentially extends through the entire length of the cylinder. More particularly, the shaft is connected to the head at an end of the cylinder, providing for its use with a traditional address and causing a certain hesitation in controlling the execution of the shot, which is not a minor disadvantage when performing the decisive shot.

BRIEF SUMMARY OF THE INVENTION

It is an object of the present invention to provide a putter that enables a positive control of the stroke, both in terms of ball speed and direction on the green.

It is a second object of the present invention to provide a method of using said putter for performing the decisive shot without any of the hesitations and problems that the devices known to data do not prevent.

One embodiment of the invention is a golf club, of the so called putter type, that includes a cylindrically shaped head with a vertical semi-through hole or bore placed in the middle of the cylindrical surface, and a second, threaded hole or bore perpendicular to the first hole for the insertion of a screw. A shaft of adjustable length (by sliding the shaft in the first hole) is inserted in the first hole and has a first portion inserted in said hole vertically and orthogonally relative to said head and further has portions, one opposite the other and bent at an angle relative to the first vertical portion, with an upper angled portion terminating with an end, which is parallel to the ground when the club is in its position of use and which supports the grip formed by two spheres of different diameter so to provide an ergonomic grip. The internal sphere is capable of sliding along the shaft in order to allow the regulation of the grip itself. Weights can appropriately be added to the head, because the head can be manufactured with internal symmetrical slots suitable for the insertion of filling elements with various weight values.

BRIEF DESCRIPTION OF THE SEVERAL VIEWS OF THE DRAWINGS

FIG. 4 is a perspective view of the grip of a golf club of FIG. 1.

FIGS. 5 and 6 are additional views of the grip of FIG. 4.

FIGS. 14 and 15 show different stroke positions according to the present invention and the prior art.

DETAILED DESCRIPTION OF EMBODIMENTS OF THE INVENTION

Figure 1:
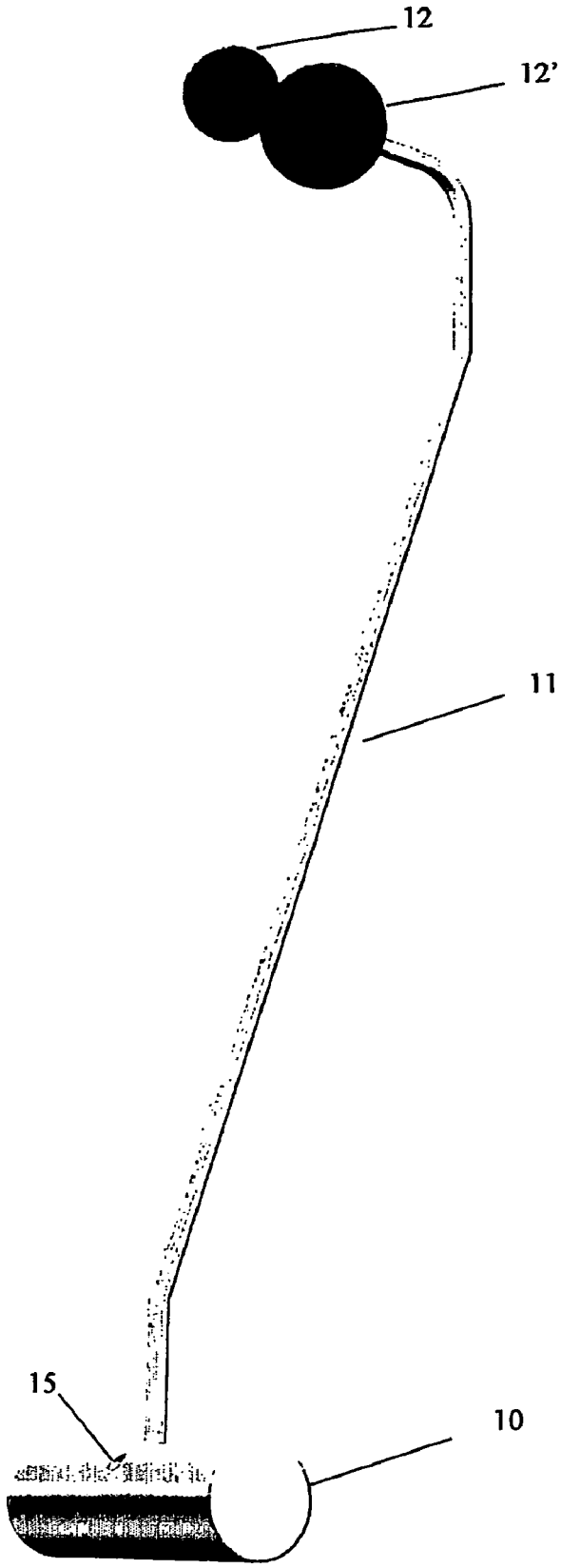
FIG. 1 is a perspective view of a first embodiment of a golf club according to the present invention.
Figure 2:
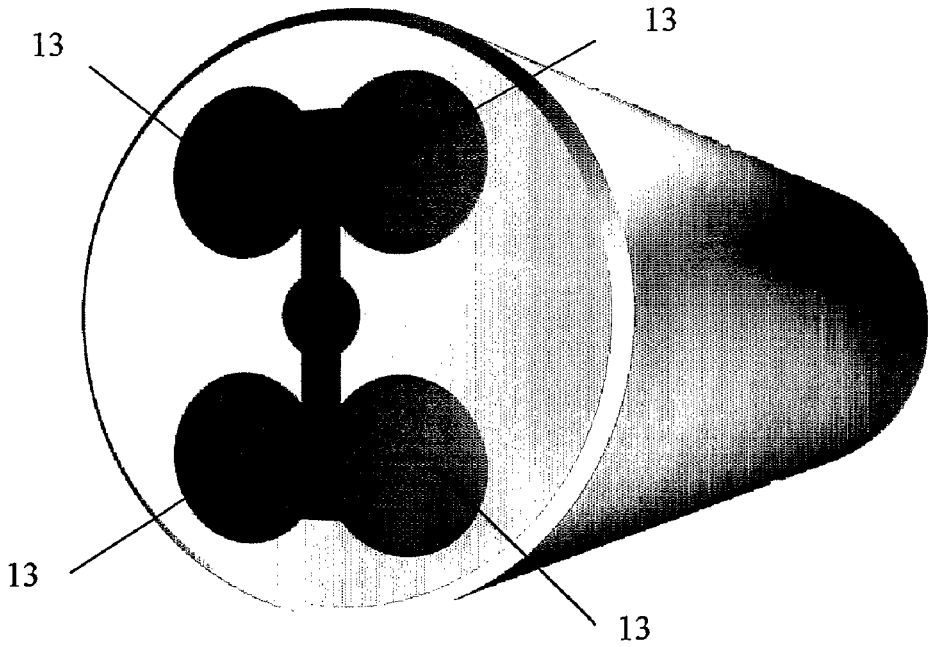
FIG. 2 is a perspective view of the head of a golf club according to a second embodiment of the invention.
Figure 3:
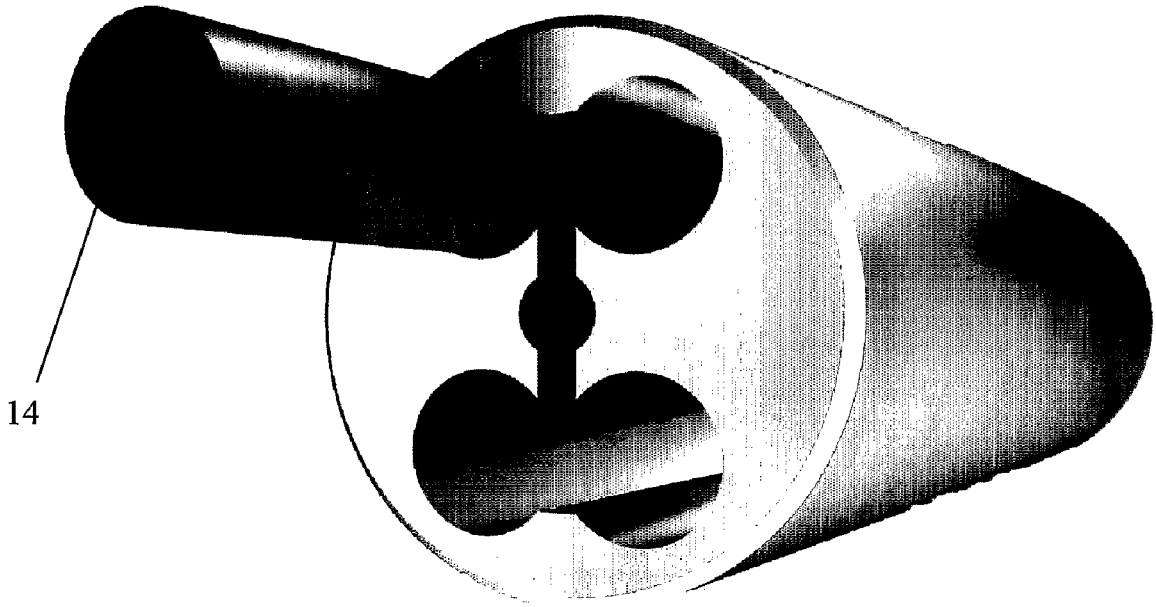
FIG. 3 is a perspective view of the head of FIG. 2 with a weight added.

FIG. 1 shows a full view of an embodiment of the golf club according to the present invention, where the cylindrical head 10, the shaft with the vertical and angled portions 11 and the grip formed by two spheres of different diameter 12 and 12', inserted in a part intended to remain horizontal when the head is laying on the green are clearly shown. In FIG. 1, said head is shown as solid, but said head could appropriately be manufactured (FIGS. 2 and 3) with special slots 13 for placing symmetrical weights 14 in order to provide a weight adjustment. Moreover, the second threaded hole 15 for the insertion of a screw could also be placed in any other position on the cylindrical head.

FIGS. 4, 5, 6 show details of the grip and of the sliding of the internal sphere 12' along the shaft.

Figure 7:
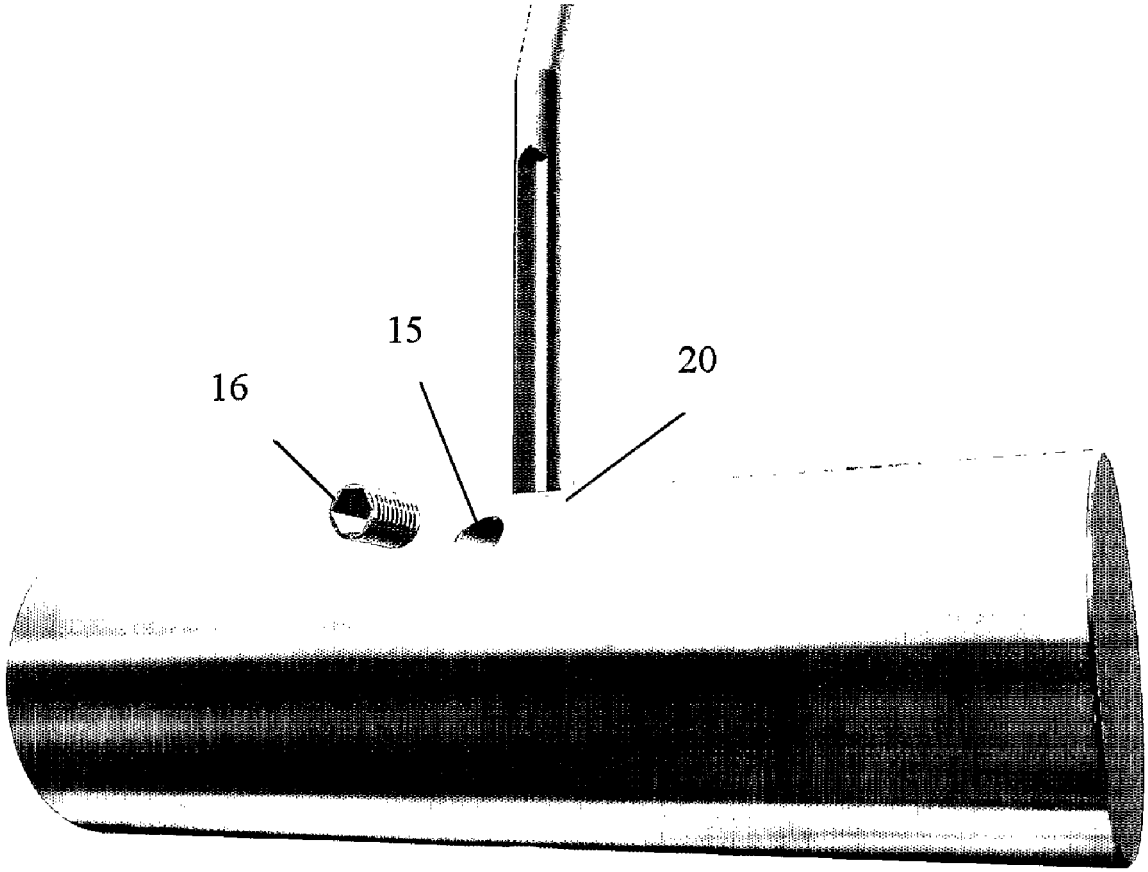
FIG. 7 illustrates the assembly of the head and the shaft of the golf club of FIG. 1.

FIG. 7 exemplifies the structure of the head. More particularly, FIG. 7 shows that the end of the shaft is inserted in the vertical semi-through hole or bore 20 and that the horizontal threaded hole 15 for the insertion of a screw 16—which blocks the system and acts at the same time as a reference for the impact with the ball—is centrally placed. With said hole in a different position, the reference for the impact with the ball is given directly by the point of insertion of the shaft.

Moreover, loosening the screw allows the head of the putter to slide along the shaft until it reaches the desired length. The regulation of the height of the shaft thus allows the club to be easily adjusted for use by players of different heights, and undoubtedly represents an advantage, which adds to the cylindrical shape of the head, enabling contact with the ball on any point on said head, even on a point different from the so called reference point, without any loss, for the golfer, of shot speed and direction.

Figure 8:
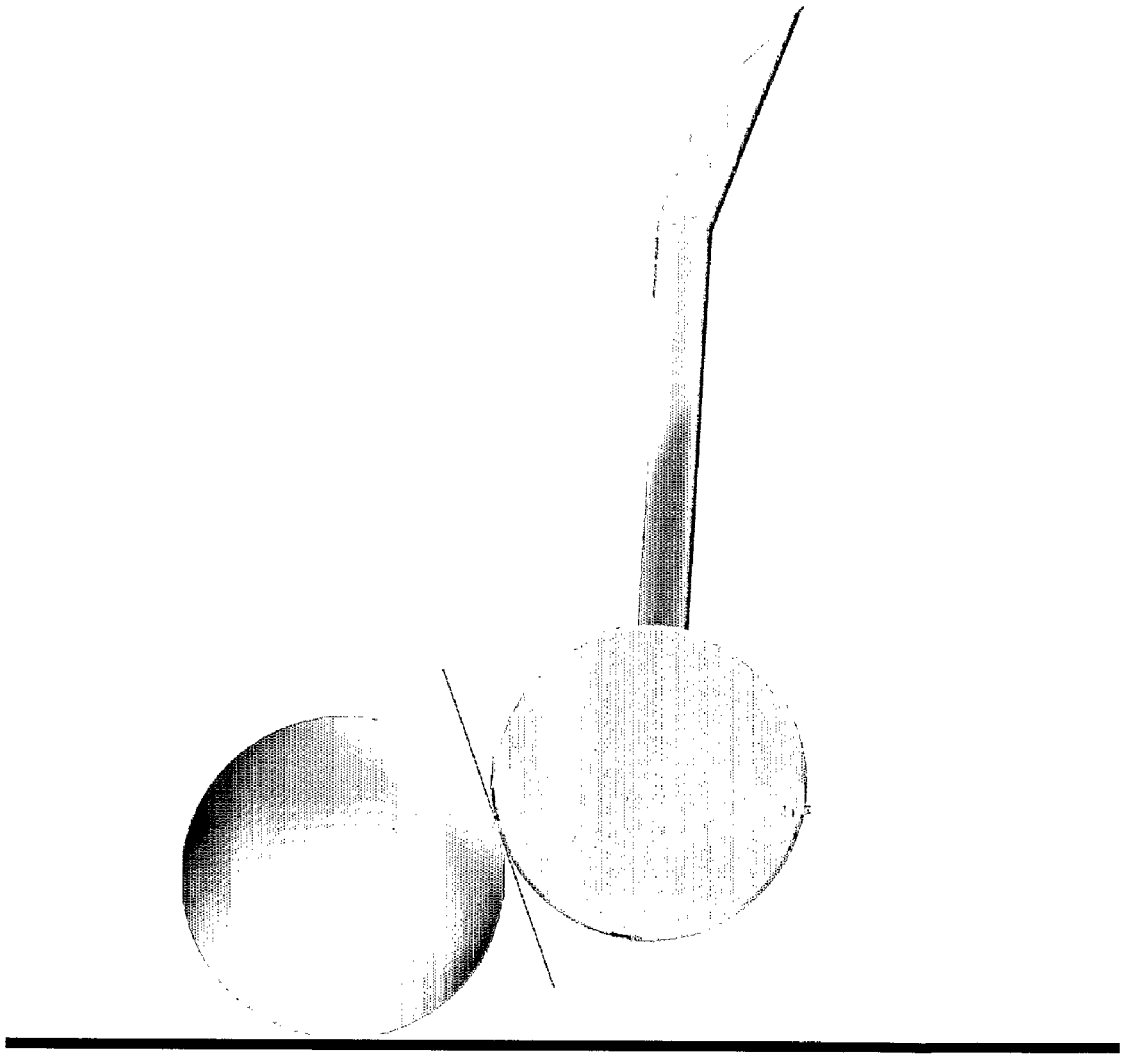
FIG. 8 is a schematic view of the impact of a golf club according to the present invention with a golf ball.

FIG. 8 is a schematic drawing of the impact between the putter and the ball, wherein the putter hits the upper part of the ball creating a top-spin effect that eases the rolling of the ball.

The shot is performed by the player according to a method, also an object of the present invention, which comprises the following steps by the golfer:

positioning the body frontally with respect to the hole;

gripping the putter grip with both hands;

positioning the feet apart from each other while holding the knees slightly bent;

positioning the arms, with the hands on the grip, so that the head of the club is next to the ball;

positioning the head of the player perpendicular on the ball;

loading the putter with a pendulum like movement using the shoulders as a pivot and the head of the putter as the mass; and oscillating the putter between the legs and hitting the ball with the long part of the cylindrical head of the putter.

Figure 9:
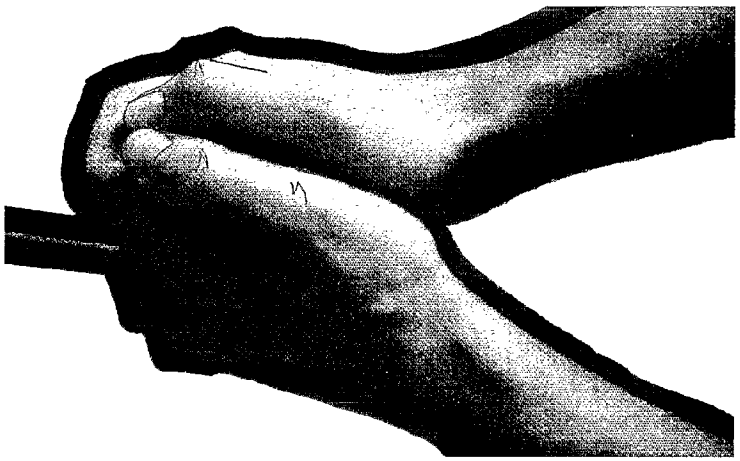
FIG. 9 illustrates the grip of a golf club according to the present invention.
Figure 10:
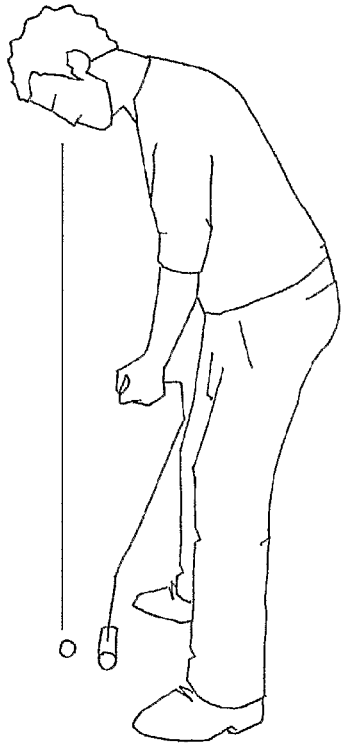
FIGS. 10 and 10' show the positioning of the body of the golfer as seen from a side and frontally.
Figure 10:
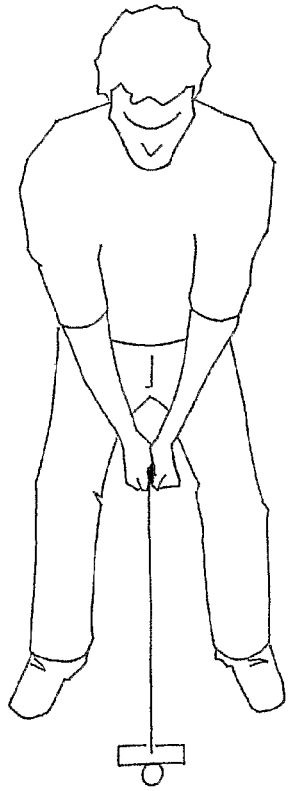

FIG. 9 shows the grip of the putter with both hands, while FIGS. 10 and 10' show the positioning of the body of the golfer as seen from a side and frontally.

Figure 11:
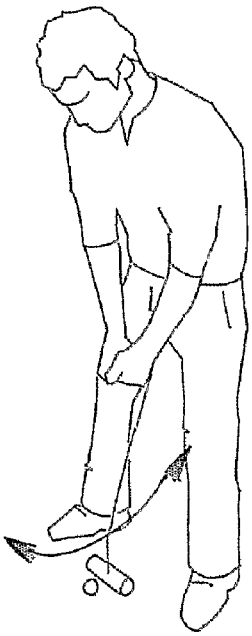
FIGS. 11/11'—12/12'—13/13' exemplify the movement preceding and accompanying a golf shot when using a club according to the present invention.
Figure 12:
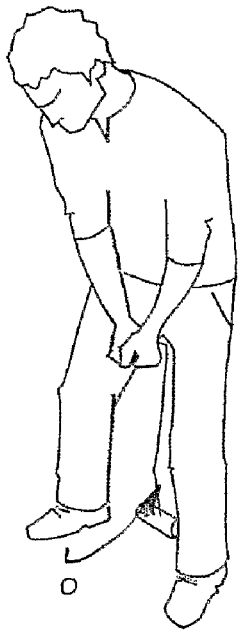
Figure 13:
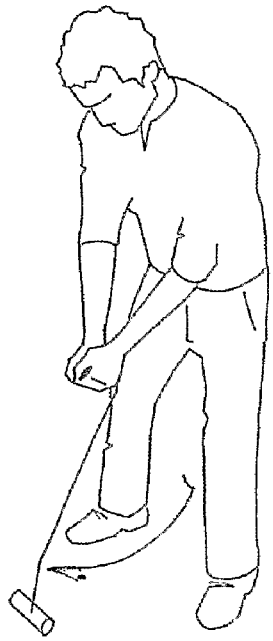
Figure 11:
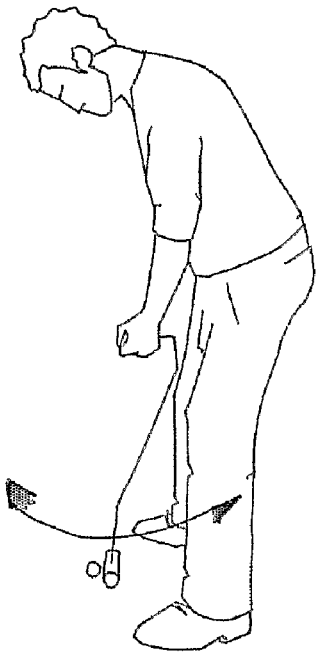
Figure 12:
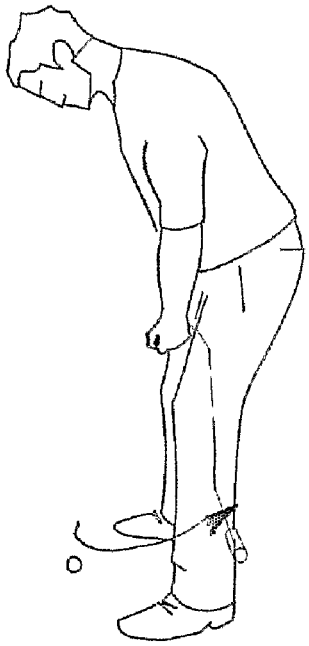
Figure 13:
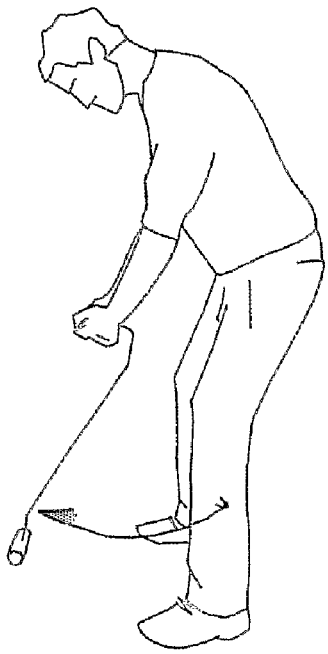

The sequence of FIGS. 11/11'—12/12'—13/13' exemplifies the movement which precedes and accompanies the shot, while FIGS. 14 and 15 show the different positions according to the present invention (A) and the traditional address (B).

The invention claimed is:

1. A putter golf club comprising:

a cylindrical head having a first lateral through bore placed midways in the head;

a shaft insertable in the first bore, the shaft comprising a first portion insertable in the first bore in a direction that is lateral and orthogonal in relation to the head, the shaft further comprising portions disposed at an angle one relative to the other, the portion furthest from the head being disposed to be in a position parallel to the ground when the club is in a position of use, wherein a portion of the shaft furthest from the head supports a grip comprising a first and a second spheres of different diameters, wherein the second sphere is disposed between the first sphere and the head, and wherein the second sphere is configured for sliding along the portion of the shaft furthest from the head.

2. The golf club of claim 1, wherein the shaft is adjustable in the first bore to provide the club with different lengths.

3. The golf club of claim 1, wherein the head comprises a second lateral bore configured for engaging a fastener.

4. The golf club of claim 3, wherein the second lateral bore is positioned midways in the head.

5. The golf club of claim 3, wherein the second lateral bore is threaded.

6. The golf club of claim 3, wherein the fastener is a screw.

7. The golf club of claim 1, wherein the head further comprises slots configured for the insertion of filling elements.

8. The golf club of claim 7, wherein the slots are disposed in symmetrical positions and parallel to a longitudinal axis of the head.

9. The golf club of claim 7, wherein the filling elements are weights.

10. The golf club of claim 1, wherein the second sphere has a diameter larger than the first sphere.

* * * * *